US008833823B2

(12) United States Patent
Price et al.

(10) Patent No.: US 8,833,823 B2
(45) Date of Patent: Sep. 16, 2014

(54) GRABBER

(71) Applicant: The Heil Co., Chattanooga, TN (US)

(72) Inventors: Thomas L. Price, Mentone, AL (US); Robert H. Doll, Pittsburgh, PA (US); Eugene Neplotnik, Pittsburgh, PA (US); David Rice, Chapel Hill, NC (US)

(73) Assignee: The Heil Co., Chattanooga, TN (US)

( * ) Notice: Subject to any disclaimer, the term of this patent is extended or adjusted under 35 U.S.C. 154(b) by 0 days.

(21) Appl. No.: 13/799,423

(22) Filed: Mar. 13, 2013

(65) Prior Publication Data

US 2013/0285401 A1 Oct. 31, 2013

Related U.S. Application Data

(60) Provisional application No. 61/640,129, filed on Apr. 30, 2012.

(51) Int. Cl.
*B66F 9/18* (2006.01)

(52) U.S. Cl.
USPC ..... 294/86.4; 294/198; 414/406

(58) Field of Classification Search
USPC ..... 294/86.4, 106, 198, 201, 902; 414/406, 414/408, 739
See application file for complete search history.

(56) References Cited

U.S. PATENT DOCUMENTS 3,954,194 A * 5/1976 Stedman ..... 414/550
4,227,849 A 10/1980 Worthington
4,242,037 A 12/1980 Baumgarten
4,313,707 A 2/1982 Bingman et al.
4,401,407 A 8/1983 Breckenridge
4,413,945 A 11/1983 LaBounty
4,435,117 A * 3/1984 House ..... 414/620
4,461,607 A 7/1984 Smith
4,461,608 A 7/1984 Boda
D306,599 S 3/1990 Hunter
5,020,844 A 6/1991 Pickrell
5,026,104 A * 6/1991 Pickrell ..... 294/86.4
5,049,026 A 9/1991 Bingman et al.
5,092,731 A 3/1992 Jones et al.
5,209,537 A 5/1993 Smith et al.
RE34,292 E 6/1993 Bingman et al.
5,398,983 A * 3/1995 Ahrens ..... 294/106
5,474,413 A 12/1995 Georg
5,505,576 A 4/1996 Sizemore et al.
5,513,942 A 5/1996 Pickrell
5,551,824 A 9/1996 Zanzig et al.
5,562,386 A 10/1996 Browning
5,577,877 A 11/1996 Smith et al.
5,651,654 A 7/1997 Christenson
D388,582 S 12/1997 Irvin, Jr.
5,702,225 A 12/1997 Ghibaudo (Continued)

FOREIGN PATENT DOCUMENTS

CA 2 358 737 4/2002

*Primary Examiner* — Dean Kramer
(74) *Attorney, Agent, or Firm* — Harness, Dickey & Pierce, P.L.C.

(57) ABSTRACT

A grabber assembly has a base to secure with the refuse collection device. A pair of arms is pivotally coupled with the base. The pair of arms moves between a grasping position and a release position. Belts are coupled with the arms. The belts contact the refuse container in the grasping position. A tensioning device tensions the belts to provide a variable force rate to tension the belts.

8 Claims, 12 Drawing Sheets

(56) References Cited

U.S. PATENT DOCUMENTS

| | | | | | |
|---|---|---|---|---|---|
| 5,711,565 | A | | 1/1998 | Smith et al. | |
| 5,720,589 | A | | 2/1998 | Christenson et al. | |
| 5,755,547 | A | | 5/1998 | Flerchinger et al. | |
| 5,759,008 | A | | 6/1998 | Smith et al. | |
| 5,769,592 | A | * | 6/1998 | Christenson | 414/408 |
| 5,813,824 | A | | 9/1998 | Zanzig et al. | |
| 5,833,429 | A | | 11/1998 | McNeilus et al. | |
| 5,846,044 | A | * | 12/1998 | Smith et al. | 414/408 |
| 5,863,086 | A | * | 1/1999 | Christenson | 294/106 |
| 5,931,628 | A | | 8/1999 | Christenson | |
| 5,934,858 | A | | 8/1999 | Christenson | |
| 5,967,731 | A | | 10/1999 | Brandt | |
| 5,975,604 | A | | 11/1999 | Wolin et al. | |
| 5,988,970 | A | | 11/1999 | Holtom | |
| 6,007,291 | A | | 12/1999 | Ghibaudo | |
| 6,012,895 | A | | 1/2000 | Smith et al. | |
| D425,528 | S | | 5/2000 | Lindgren et al. | |
| 6,095,744 | A | | 8/2000 | Harrison | |
| 6,183,185 | B1 | | 2/2001 | Zanzig et al. | |
| 6,210,094 | B1 | | 4/2001 | McNeilus et al. | |
| 6,213,706 | B1 | | 4/2001 | Christenson | |
| D442,757 | S | | 5/2001 | Loflin, Sr. | |
| 6,350,098 | B1 | | 2/2002 | Christenson et al. | |
| 6,390,758 | B1 | | 5/2002 | McNeilus et al. | |
| 6,474,928 | B1 | | 11/2002 | Christenson | |
| 6,494,665 | B1 | | 12/2002 | Bingman | |
| 6,644,906 | B2 | | 11/2003 | Bayne | |
| 6,719,226 | B2 | | 4/2004 | Rajewski | |
| 6,761,523 | B2 | | 7/2004 | Hund, Jr. et al. | |
| 6,821,074 | B2 | | 11/2004 | Schreiber et al. | |
| 7,037,061 | B2 | * | 5/2006 | Hund et al. | 414/408 |
| 7,066,514 | B2 | | 6/2006 | Smith et al. | |
| 7,086,818 | B2 | | 8/2006 | Pruteanu et al. | |
| D553,162 | S | | 10/2007 | Cazes | |
| 7,347,657 | B2 | | 3/2008 | Brunn | |
| D586,074 | S | | 2/2009 | Auf der Maur | |
| 7,559,735 | B2 | | 7/2009 | Pruteanu et al. | |
| D668,832 | S | | 10/2012 | Auf der Maur | |
| D671,294 | S | | 11/2012 | Auf der Maur | |
| D672,369 | S | | 12/2012 | Secker et al. | |
| D676,213 | S | | 2/2013 | Dyrvall et al. | |
| D685,974 | S | | 7/2013 | Price et al. | |
| 2001/0001637 | A1 | | 5/2001 | Zanzig et al. | |
| 2002/0159870 | A1 | | 10/2002 | Pruteanu et al. | |
| 2007/0059148 | A1 | | 3/2007 | Westendorf et al. | |
| 2011/0243692 | A1 | | 10/2011 | Fortin et al. | |
| 2013/0057007 | A1 | | 3/2013 | Howell et al. | |

* cited by examiner

GRABBER

CROSS-REFERENCE TO RELATED APPLICATION

This application claims the benefit of U.S. Provisional Application No. 61/640,129, filed on Apr. 30, 2012. The entire disclosure of the above application is incorporated herein by reference.

FIELD

The present disclosure relates to refuse collection and, more particularly, to a grabber for picking up refuse containers.

BACKGROUND

Grabbers are the primary interface between a lifting device and a refuse collection container. In designing grabbers, the function is to secure the refuse container, support the weight of a loaded container, lift the container and empty it in the collection vehicle. This is to occur without distorting the container in any way that may either damage the container or prevent refuse from exiting the container in a dumping position. Also, the maneuverability of the grabber is important in that containers are often positioned in close proximity to one another and to other objects. Having a grabber that can easily approach and secure a container in close quarters is an enhancement to the functionability of the grabber.

The present disclosure provides the art with a grabber having an arm geometry to surround a wide variety of containers. The arm geometry prohibits contact of the container by the arm itself. Thus, this eliminates damage and distortion to the containers. The grabber includes a belt that concentrates the highest gripping force on the corner of the container where the container is the stiffest.

The present disclosure also provides a grabber with implements that are substantially parallel with one another enabling maximum versatility in selecting containers in close quarters.

The disclosure also provides a tensioning device that enables the belt to have a varied tensioning force. Further, the present disclosure provides a gear mechanism that is readily removable from a housing for gear replacement.

SUMMARY

According to the disclosure, a grabber assembly comprises a base for securing with a refuse collection device. A pair of arms is pivotably coupled with the base. The pair of arms moves between a grasping position and a release position. A belt is coupled with the arms. The belt contacts a refuse container in the grasping position. A tensioning device is provided to tension the belt. The tensioning device provides a variable tension on a force in the belt. The tensioning device includes a pair of springs with a first and second spring force rate. The spring force rate of the second spring is larger than the spring rate of the first spring.

A grabber assembly comprises a base to secure with the refuse collection device. A pair of arms pivotally couple with the base. The pair of arms moves between a grasping position and a release position. A belt is coupled with the arms. The belt contacts a refuse container in the grasping position. A pair of flippers is provided with each arm coupled with a distal end of each of the arms. The flippers are movable between a grasping and a release position. The flippers are independently actuated with respect to the arms. The flippers are capable of being positioned substantially parallel to one another.

According to another aspect, a grabber assembly comprises a base to secure with the refuse collection device. A pair of arms is pivotally coupled with the base. The pair of arms moves between a grasping position and a release position. The belt is coupled with the arms. The belt contacts a refuse container in the grasping position. A pair of readily removable gear sections meshes with one another to move the arms with respect to one another. Each gear section includes a housing with a bore to receive a pivot pin. A pair of space plates is on the housing. A removable gear portion is coupled between the plates. At least one removable fastener secures the gear portion with the plates.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
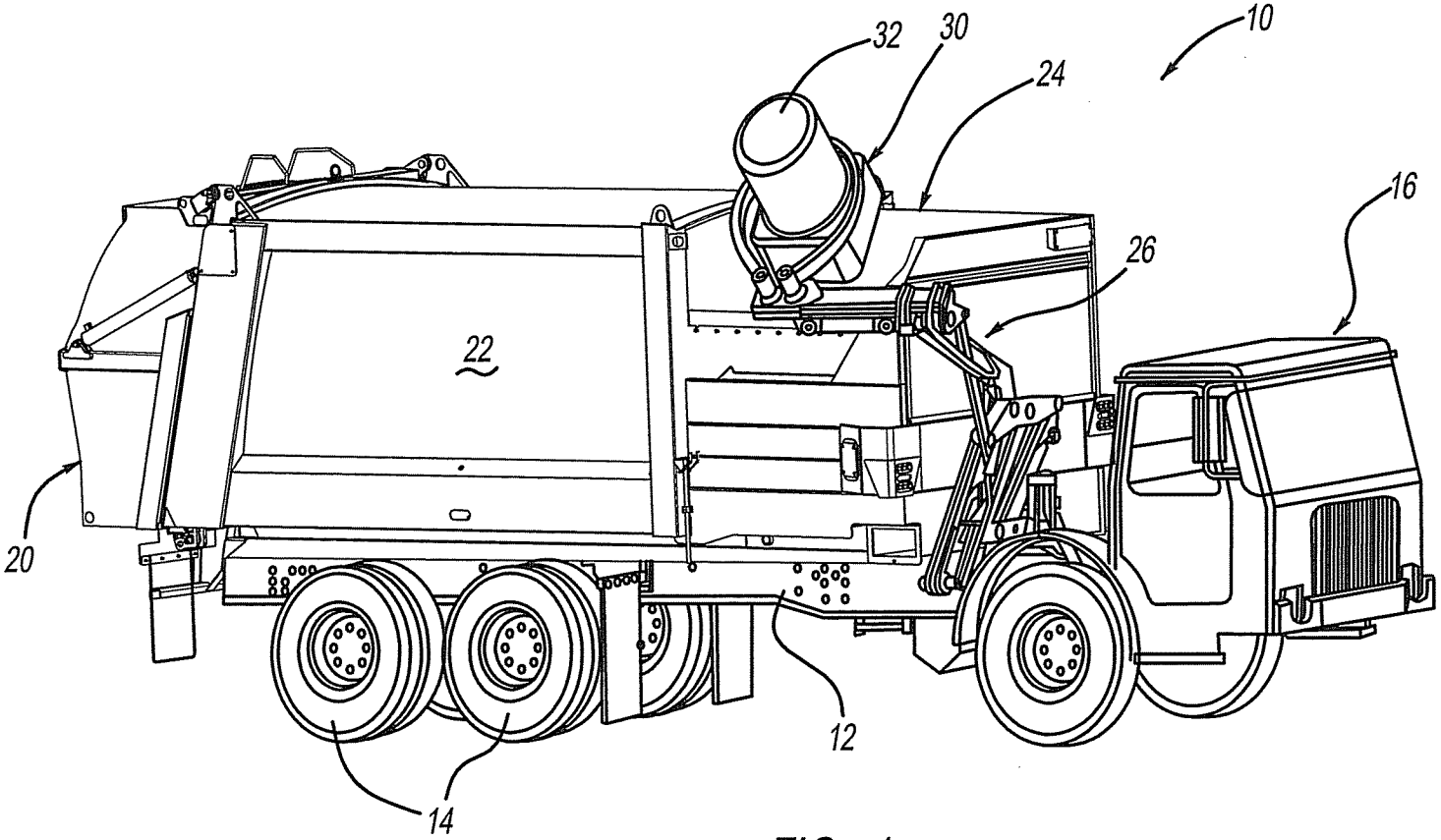
FIG. 1 is a perspective view of a refuse collection vehicle.

Turning to the figures, a refuse collection vehicle is illustrated and designated with the reference numeral 10. The refuse collection vehicle includes a frame 12, supported by wheels 14, a cab 16 and an internal combustion engine (not shown). The cab also includes a steering wheel, brakes, etc. to drive the vehicle 10. The refuse collection device 20 is positioned on the frame 12. The refuse collection device 20 includes a body 22, a hopper 24, and a lift arm 26. The lift arm 26 includes a grabber 30 that grasps refuse container 32 and dumps the refuse container 32 into the hopper 24. The hopper 24 also includes a packer assembly or ram (not shown) that pushes the refuse into the body 22 (see FIG. 1).

A position sensor (LVDT, rotary sensor) is placed on the packer assembly or ram so that the position of the packer is always known. The position of the packer could be a parameter that is modifiable by the user. This could be advantageous because at the beginning of a route, the user could set the packer to just clear the hopper. At the end of the route, the user could set the packer to execute a full pack. This information could also be used in conjunction with load weight and cylinder pressure to approximate the density of the load that is being carried. Thus, this provides information that could be used to optimize routes and vehicle efficiency.

Figure 2:
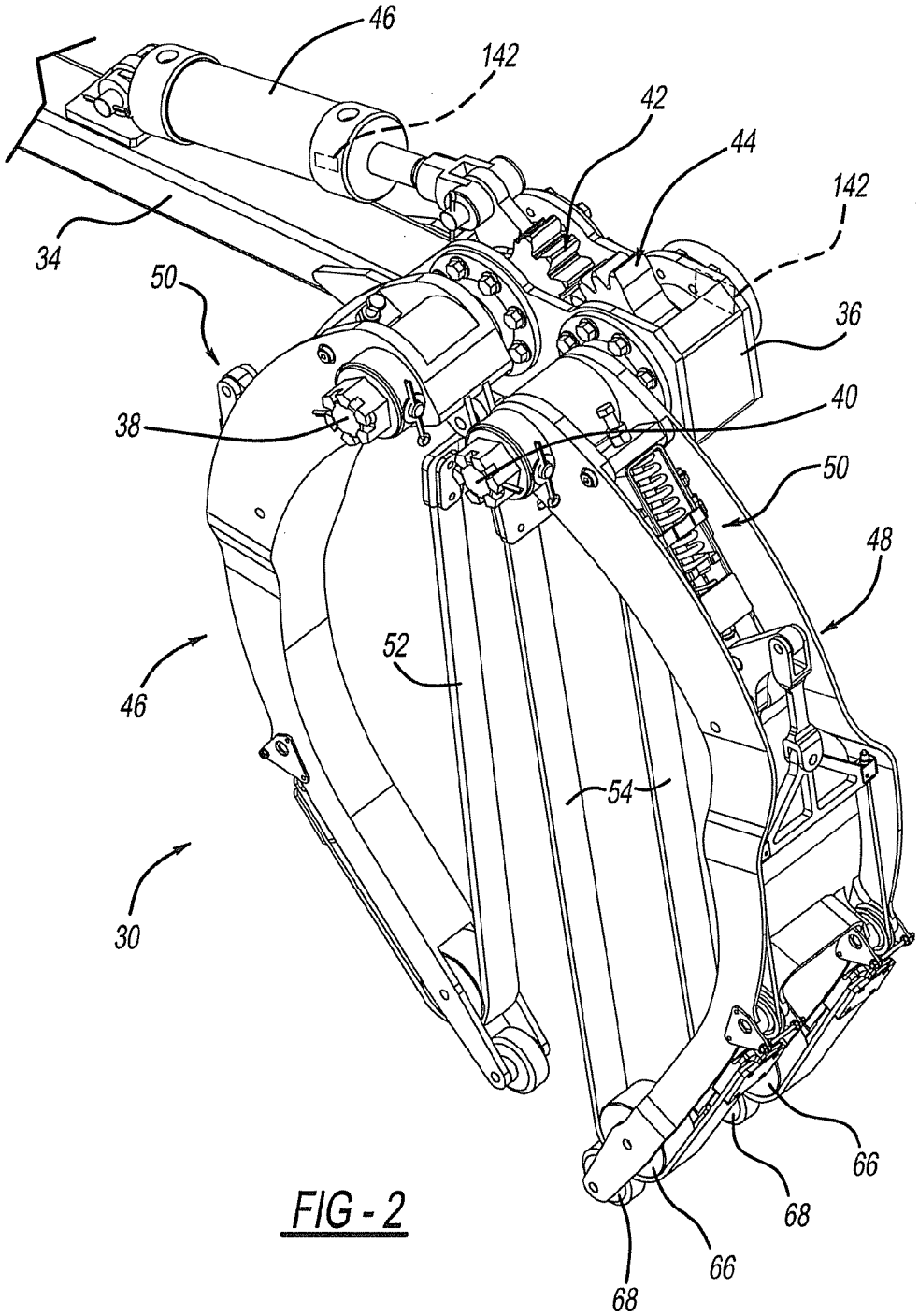
FIG. 2 is a perspective view of a grabber assembly in accordance with the disclosure.

Turning to FIG. 2, the grabber assembly 30 includes a base 34 coupled with the lifting arm 26. The base includes a housing 36 that includes a pair of pivots 38 and 40. Gear mechanisms 42, 44 are coupled with the pivots 38, 40 for rotational purposes. Also, a powered cylinder 46 is coupled with gear mechanisms 42, 44 to drive the gear mechanisms 42, 44 which, in turn, drive the arms 46, 48.

Arms 46, 48 are coupled with the pivots 38, 40. Each arm 46, 48 include a belt tensioning mechanism 50. The belt tensioning mechanism 50 is coupled with belts 52, 54.

Figure 3:
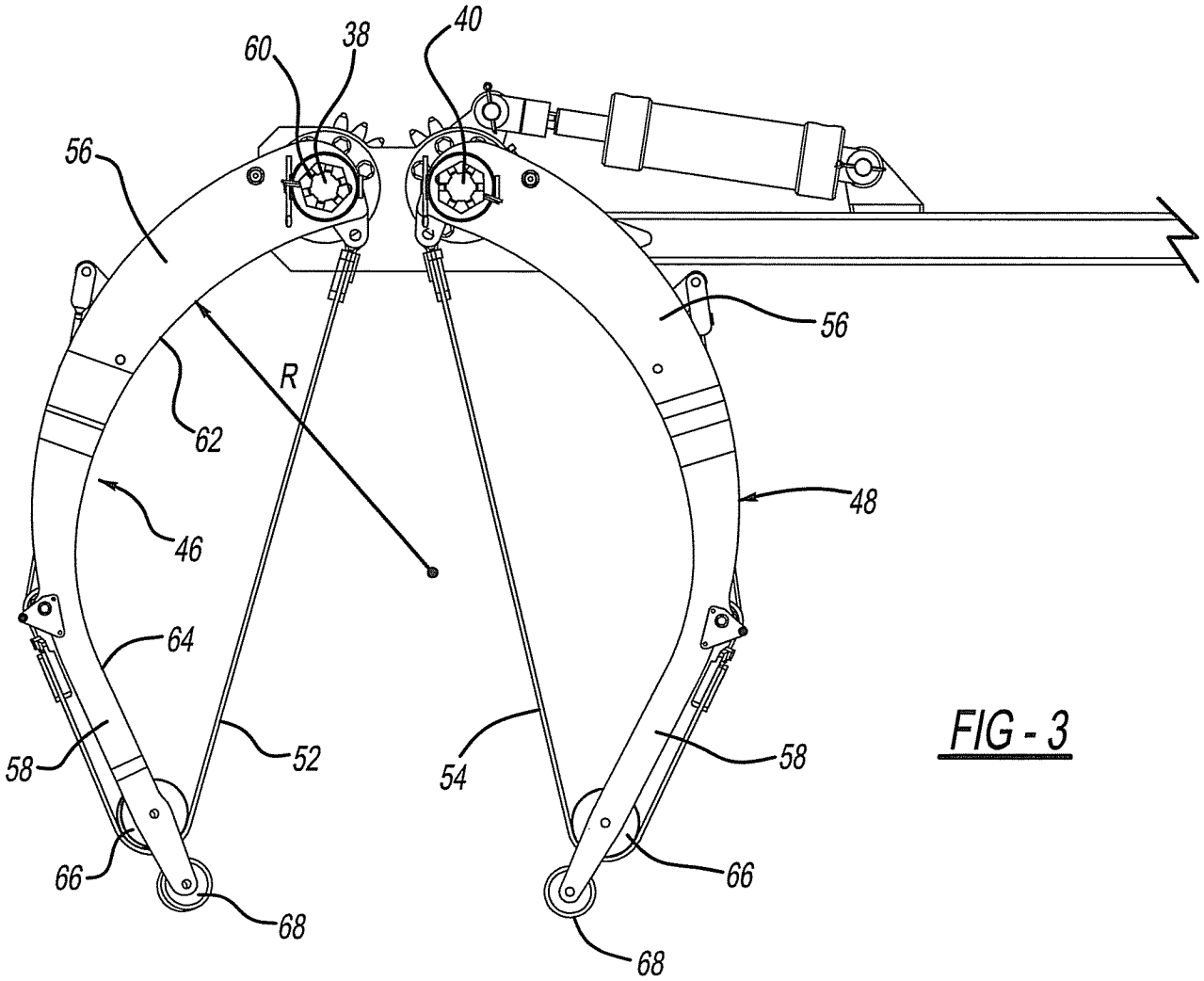
FIG. 3 is a top plan view of the grabber assembly in FIG. 2.
Figure 8:
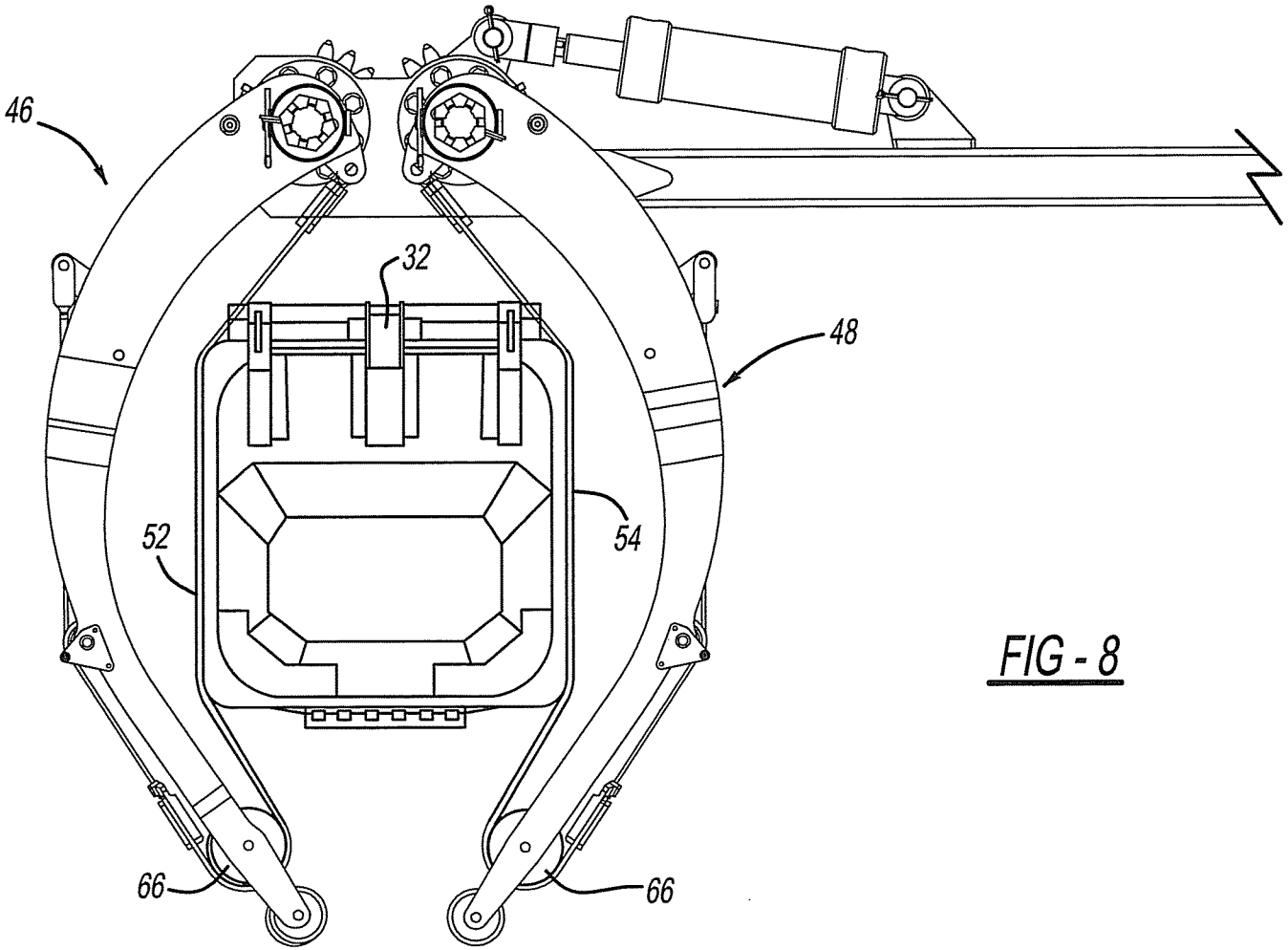
FIG. 8 is a view like FIG. 7 with the container in a grasped position.
Figure 9:
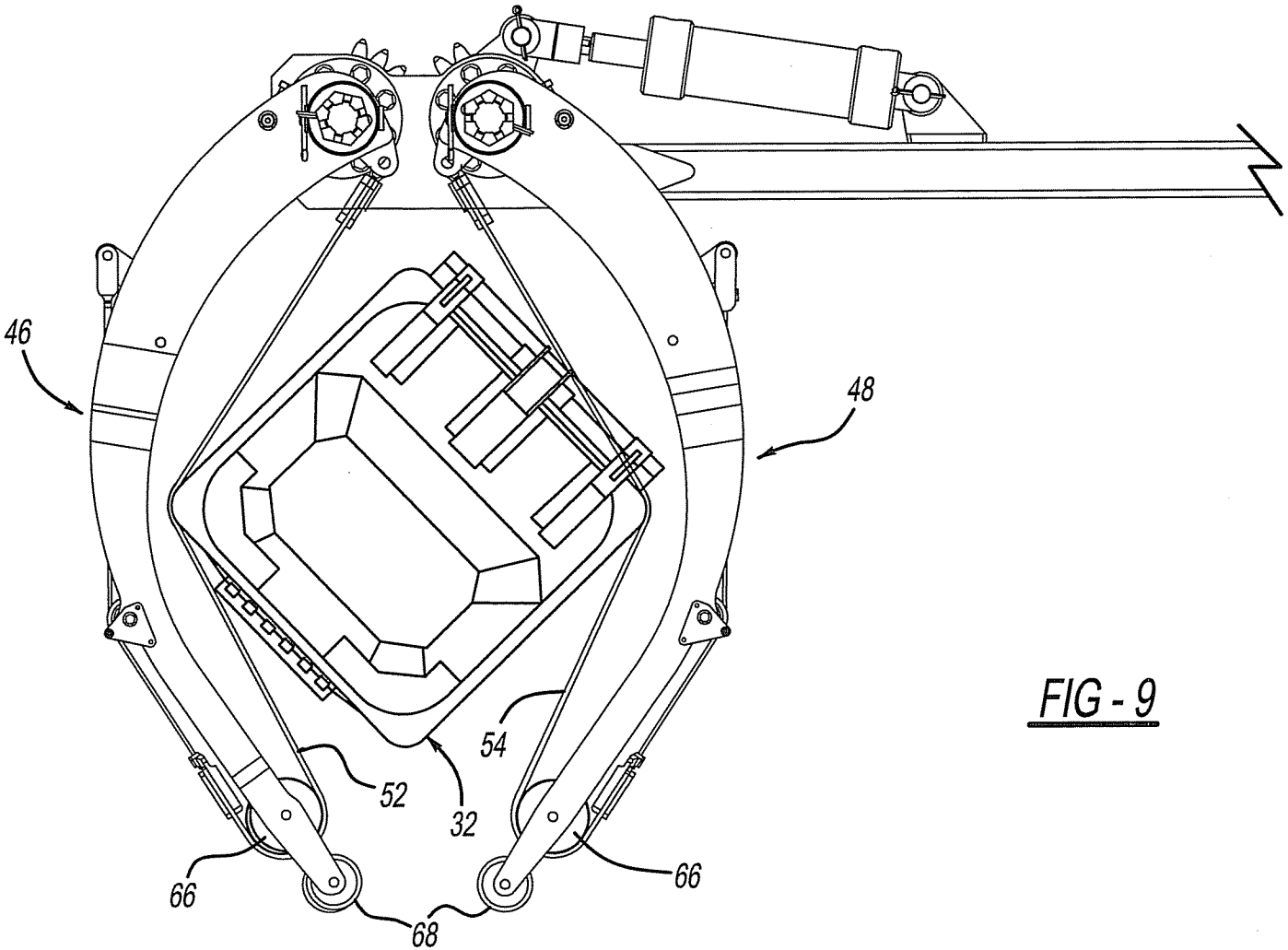
FIG. 9 is a view like FIG. 8 with the container rotated 45°.

The arms 46, 48 have an upper portion 56 and the lower portion 58. The upper portion 56 includes a bore 60 that receives the pins 38 and 40. The upper portion 56 includes an inner surface 62 that is positioned along a radius R from the proximal end of the upper arm 56 attached with the pin 38, 40 throughout approximately two-thirds of the arm length. The lower portion 58 includes an inner surface 64 that is tangent with the arcuate surface 62. A pulley 66 is on arm 46 and a pair of pulleys 66 is on the arm 48. Also, rollers 68 are at the distal ends of the arms 46, 48. Thus, the arms 46, 48 are elongated and the pulleys 66 are positioned behind the containers 32 as seen in FIGS. 3, 8 and 9.

Figure 4:
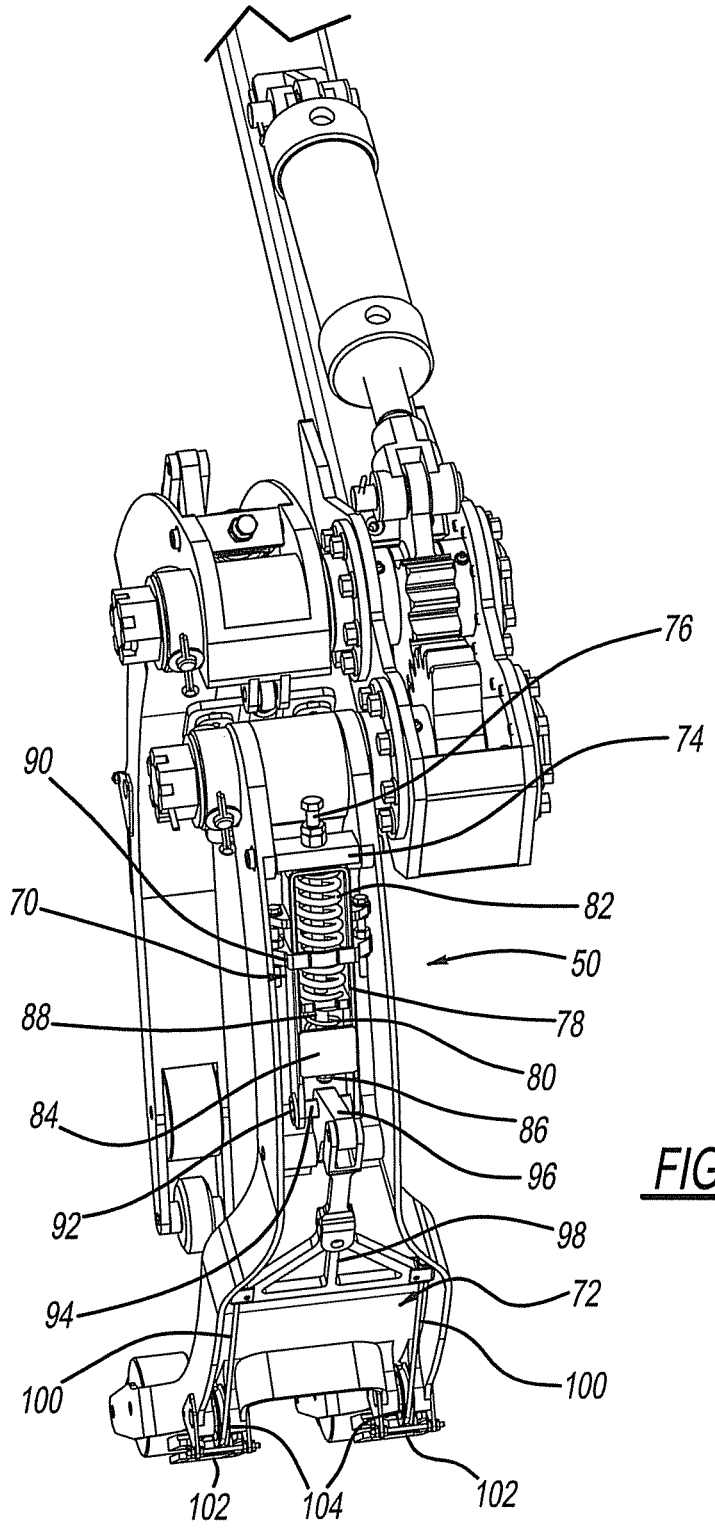
FIG. 4 is a side elevation view of the grabber of FIG. 2.

Each arm includes a belt tensioner 50. The belt tensioner 50 enables a variable force to be applied by the belts 52, 54 onto the container 32. The belt tensioner 50 generally includes a biasing mechanism 70 and an attachment mechanism 72 coupling with the belts 52, 54. The biasing mechanism 70 ordinarily includes a base 74 with a perpendicular rod 76 extending from it (FIG. 4). A slidable housing 78 is positioned along the rod 76. A first 80 and second 82 spring are positioned around the rod 76. A spring pad 84 is positioned on the rod 76. A nut 86 pretensions the springs. Also, a second spring pad 88 is positioned between the first 80 and second 82 springs. A spring stroke limiter 90 is coupled with the housing 78. This limits the compression of both springs 80, 82 as the spring pad 88 contacts the limiter 90 limiting the stroke of the tensioner. The end of the housing 78 includes a clevis 92. The clevis 92 has a bore that receives a pin 94 attached to a crank 96. The crank 96 is attached with the connection assembly 72.

The connection assembly 72 includes a bracket 98 which includes a pair of straps 100 that connect with belt clamping assemblies 102 that clamp the belts 54. Also, pulleys 104 enable the straps 100 to move as the belts 54 are tensioned (FIG. 4).

Figure 5:
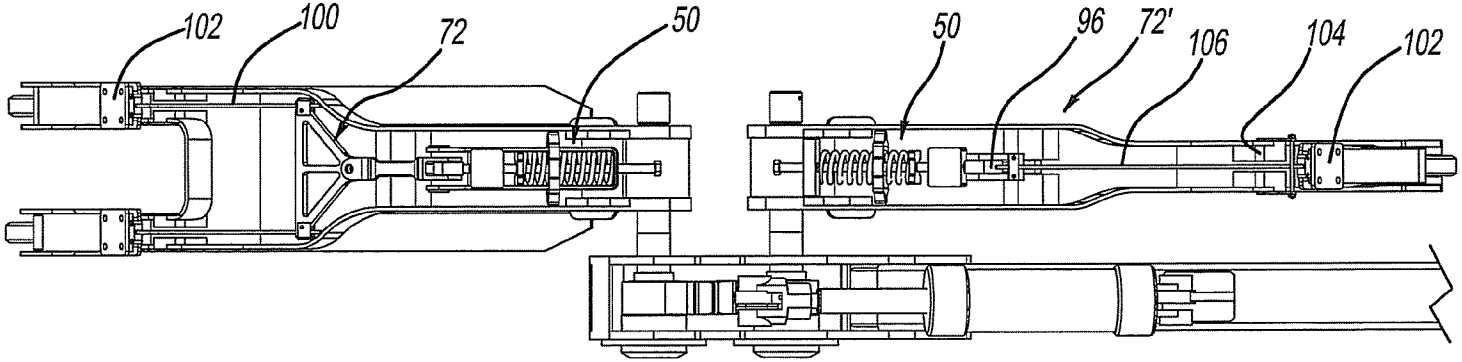
FIG. 5 is a rear elevation view of the grabber of FIG. 2.
Figure 6:
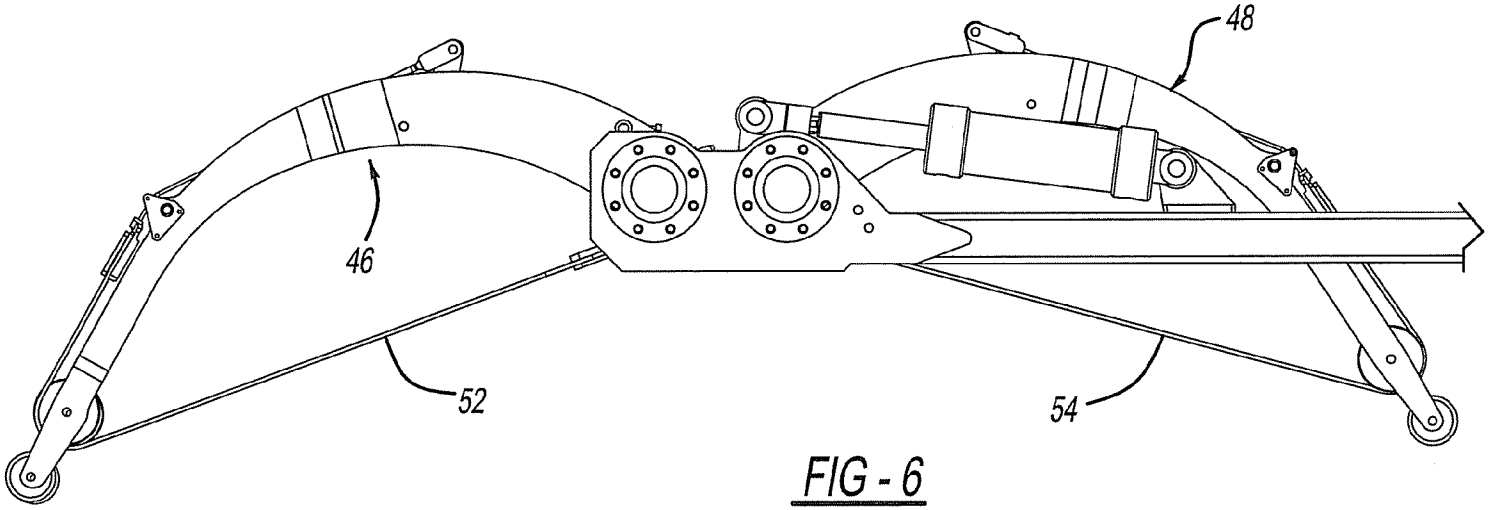
FIG. 6 is a view like FIG. 2 with the arms in an open position.

The belt tensioner 50 on arm 46 differs from the tensioner 50 on arm 48 only in the connection assembly 72'. Here, since it includes a single belt clamp 102, a single strap 106 is connected directly with the crank 96 (FIG. 5).

Figure 7:
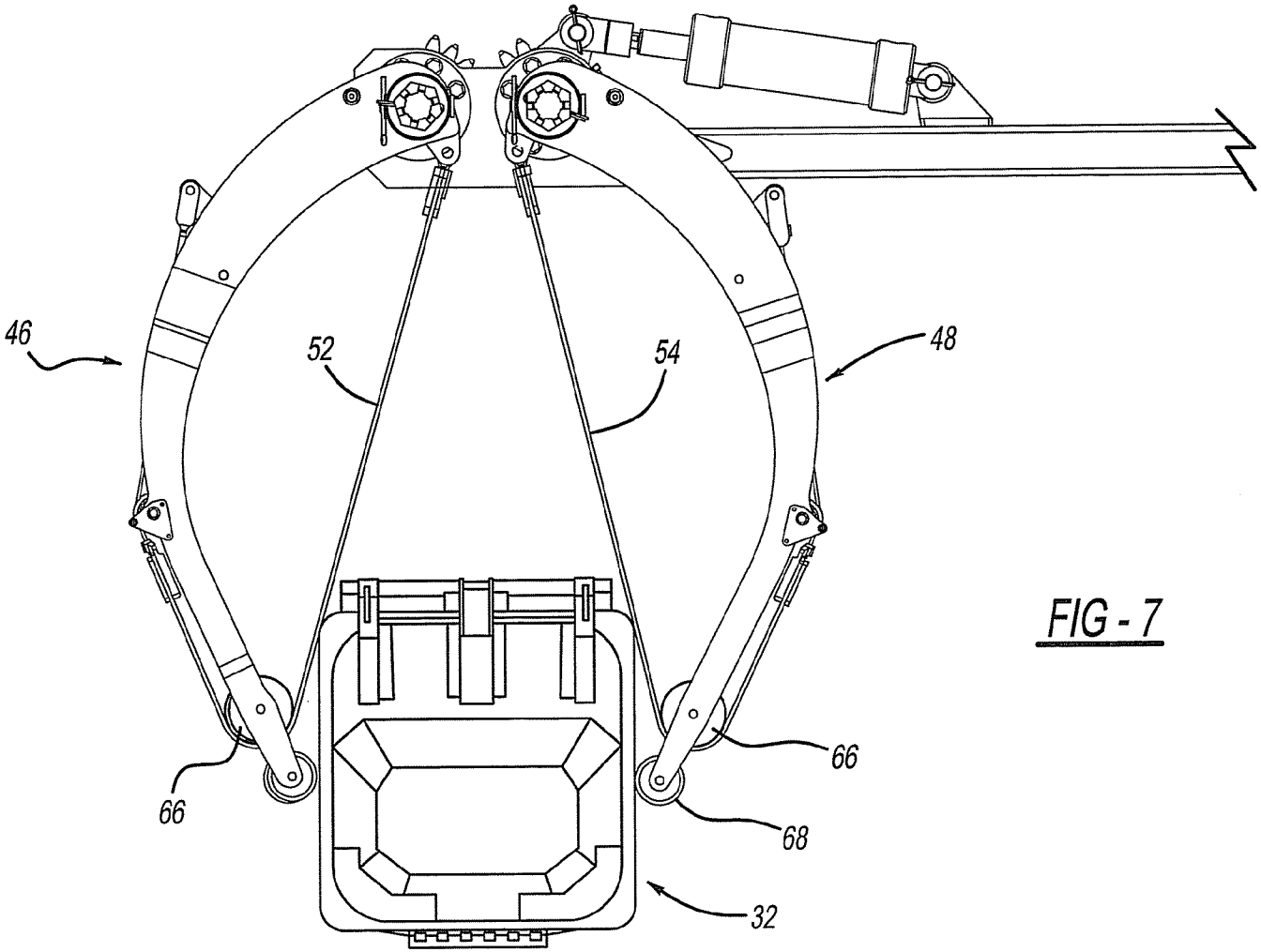
FIG. 7 is a view like FIG. 3 with a container.

When a container enters the arms 46, 48, the belts 52, 54 contact the container 32. As this happens, due to the spring force of the first spring 80, the belts 52, 54 enable the container 32 to be received into the belts 52, 54. As the arms 46, 48 continue to be rotated around the container 32, the second spring 82 begins to provide a force to tension the belts so that the belts 52, 54 apply a force onto the container 32 to retain the container 32 within the gripping arms 46, 48. Due to the variable tension as well as the design of the arms 46, 48, only the tensioning belts 52, 54 contact the container 32. The tensioning belts 52, 54 do not contact the arms 46, 48 as the arms 46, 48 are moved around the container 32. Thus, as can be seen in FIGS. 7-9, the arms 46, 48 are capable of grasping the container 32 at various orientations with only the belts 52, 54 contacting the container 32. This provides better grasping of the container to enable emptying of the container 32 without the container 32 being contacted by the arms 46, 48. Thus, this reduces the possibility of damaging the container 32.

Figure 10:
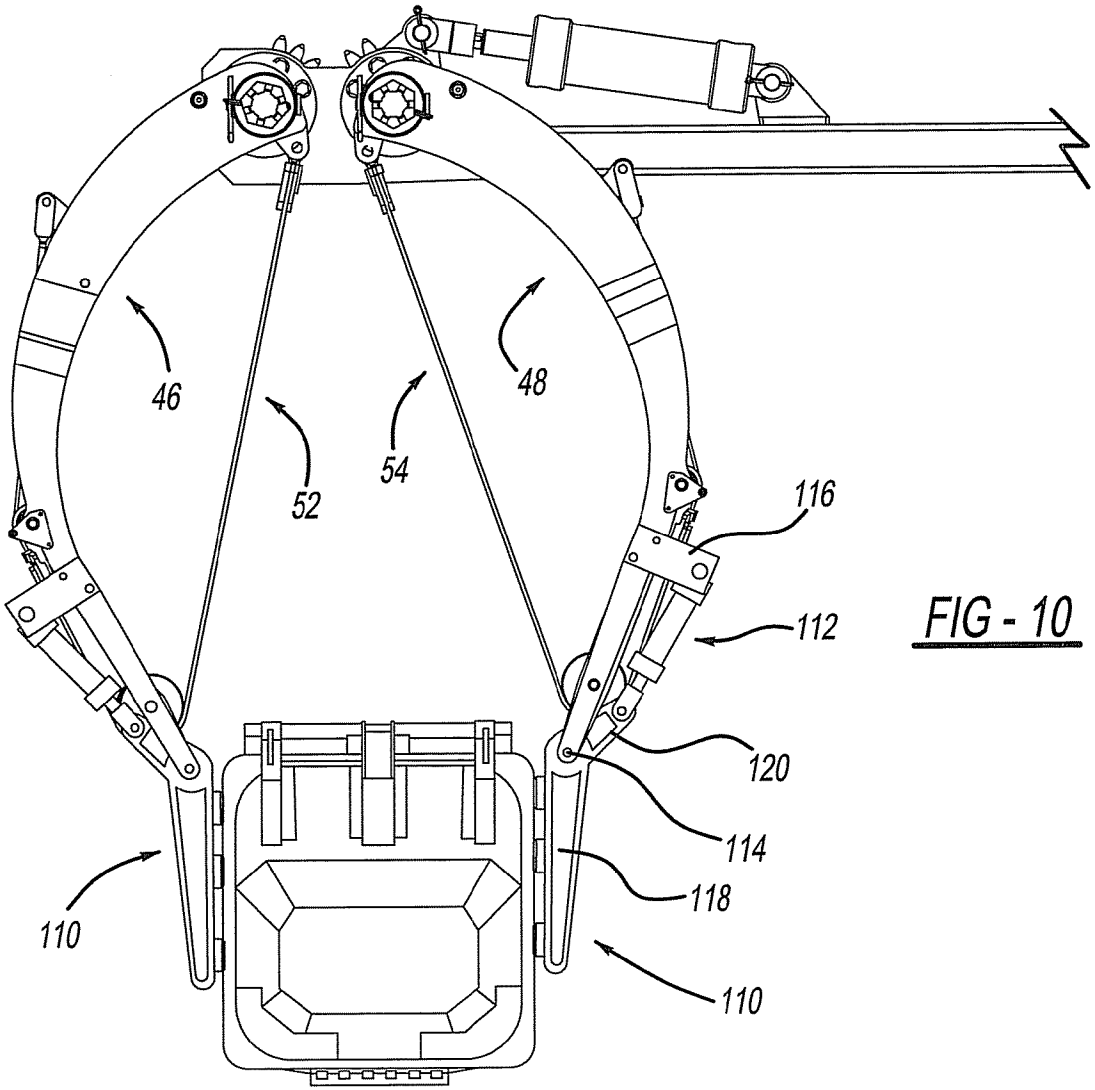
FIG. 10 is a top plan view of a second embodiment of a grabber.
Figure 11:
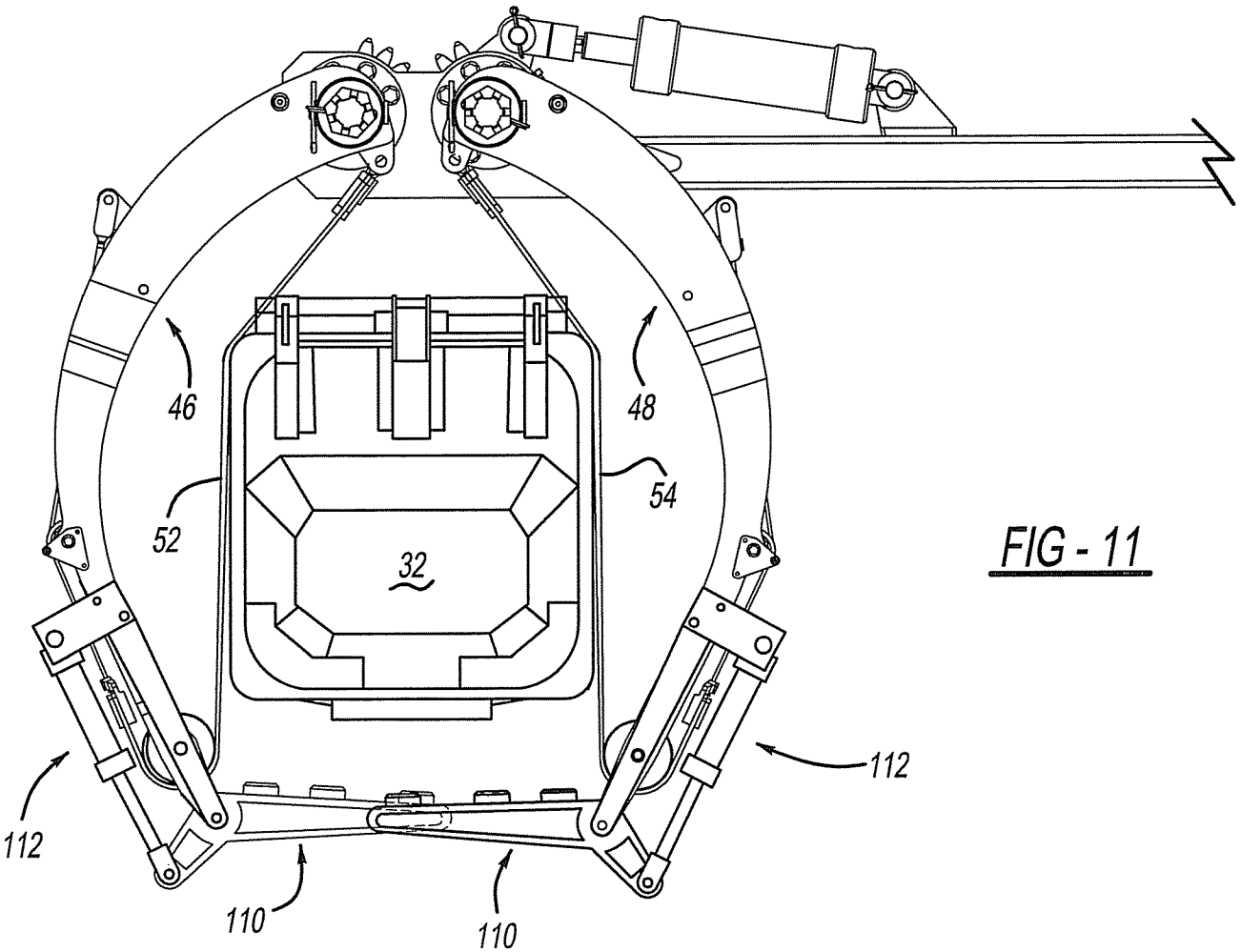
FIG. 11 is a view like FIG. 10 with the container in a grasped position.

Turning to FIGS. 10 and 11, a second embodiment is illustrated. The second embodiment is like the first embodiment except that the rollers 68 have been replaced by flippers 110. The flippers 110 include an assembly 112, such as a hydraulic or pneumatic cylinder, that opens and closes the flippers 110. The flippers 110 include a bore 114 to receive the pivot pin to enable the flippers 110 to pivot about the end of the arms 46, 48. The assembly 112 includes a bracket 116 to secure it with the arms 46, 48. The flipper 110 has an overall L shape with an obtuse angle between the legs 118, 120. The bore 114 is positioned at the junction between the two legs 118, 120. Generally, leg 120 is coupled with an anchor of the assembly 112. The flippers 110 are positioned substantially parallel with the lower arm portions 58 so that they may be moved forward to engage containers 32 that are positioned close with one another as seen in FIG. 10. The flippers 110 may grab a container and pull it away from the remaining containers or obstacles. Thus, this provides a minimum cross sectional area reducing the area needed to surround a container. Additionally, once the flippers 110 have passed beyond the back of the container 32, the flippers 110 can be actuated independently of the arms 46, 48 to rotate around the rear of the container (FIG. 11).

Figure 12:
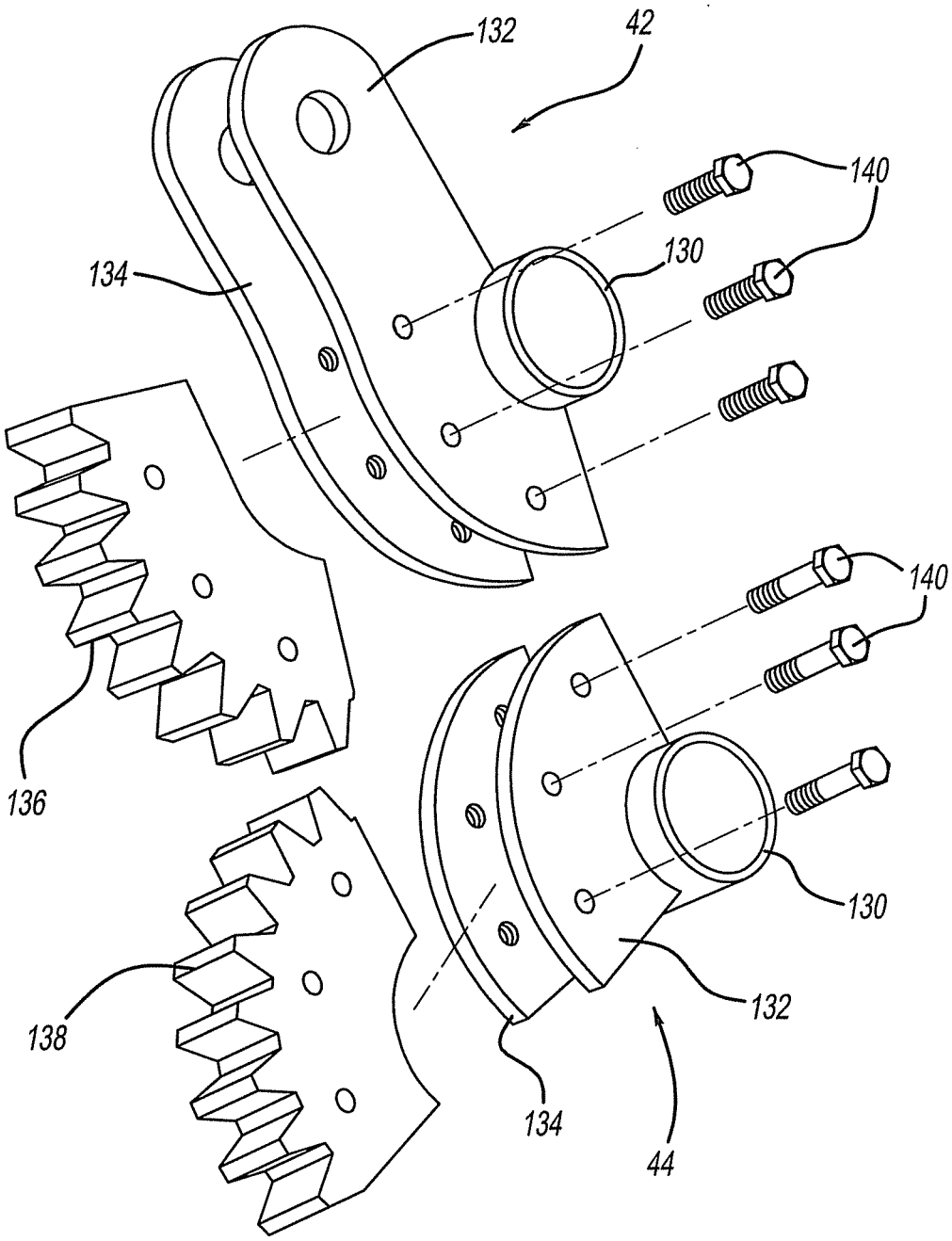
FIG. 12 is an exploded perspective view of the gear assemblies.

The gear sections 42, 44 provide additional versatility for the grabber 30. Gear sections 42, 44 are formed with a hollow cylinder 130 and a pair of plates 132, 134 forming a housing (see FIG. 12). Generally, they are welded or the like together to provide a unit. Gear sections 136, 138 are received between the plates 132, 134. The gear sections 136, 138 may have an arcuate shape or the like to fit between the plates 132, 134. Fasteners 140 are readily removable so that the gear sections 136, 138 may be readily removed from the plates 132, 134. Thus, the fasteners 140 enable the gear sections 136, 138 to be removed from the plates and replaced when they are worn without the necessity of removing the gear sections 42, 44 from the pins 38, 40.

Figure 13:
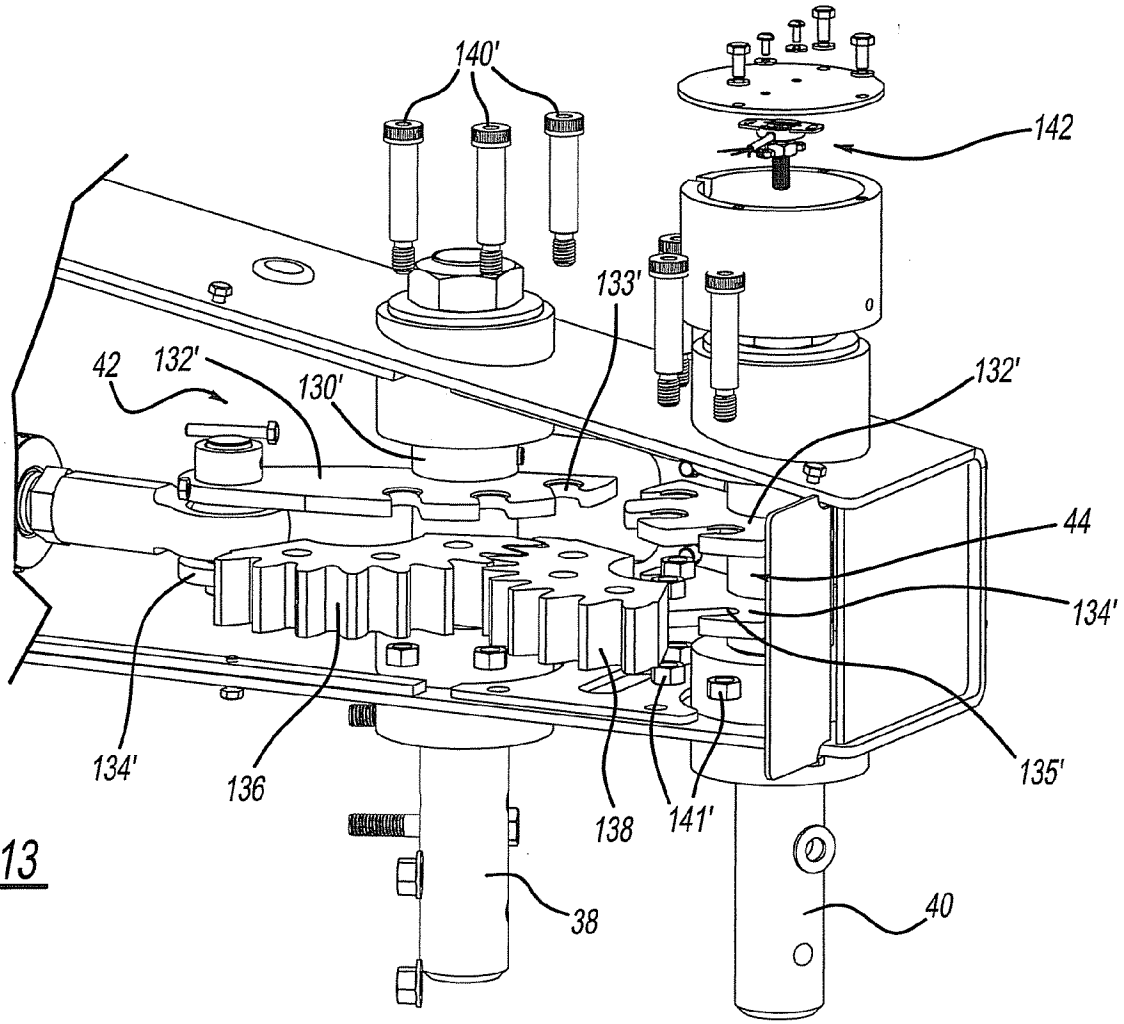
FIG. 13 is an exploded perspective view of alternative gear assemblies.

FIG. 13 illustrates an alternative embodiment for the gear sections 42, 44. The gear sections include a hollow cylinder 130' and a pair of plates 132', 134' forming a housing. The plates 132', 134' include a plurality of slots 133', 135' to receive the fasteners 140'. The fasteners 140' pass through the gear sections 136, 138. The gear sections 136, 138 have an arcuate shape to fit between the plates 132', 134'. Thus, the fasteners 140' pass through the plates 132', 134' as well as the gear sections 136, 138. A plurality of nuts 141' secure with the fasteners 140' to secure the gear sections 136, 138 with the plates 132', 134'. Thus, the fasteners 140' enable the gear sections 136, 138 to be removed from the plates and replaced when they are worn without the necessity of removing the gear sections 42, 44 from pins 38, 40.

A position sensor 142 (LVDT, rotary sensor) is placed on the grabber assembly 30 so that the position or rotation of the arms 30 is always known. The sensor 142 may be coupled with the cylinder 46 to measure the piston rod stroke or with a pin 40 to measure the rotational angle. Ordinarily, a magnetic pickup on the piston rod or pin is sensed by the sensor 142 to determine position. By knowing arm position, this enables the user to set the closed position of arms and the open position of the arm anywhere along the arc of travel. Knowing and being able to control and set this parameter is advantageous because a user would be able to set the degree of closure for different sized containers. Thus, as container sizes change, the diameter of the cross-section changes, therefore by setting the optimized location of closed arms for a small can or a large can could be done at the press of a button.

The description of the disclosure is merely exemplary in nature and thus, variations that do not depart from the gist of the disclosure are intended to be within the scope of the disclosure. Such variations are not to be regarded as a departure from the spirit and scope of the disclosure.

What is claimed is:

1. A grabber assembly comprising:

a base for securing with a refuse collection device;

a pair of arms pivotally coupled with the base, the pair of arms moving between a grasping position and a release position;

a belt coupled with the arms, the belt attached adjacent the base and having a portion moving over a roller near a distal end of the arms, the belt contacting a refuse container in the grasping position; and a tensioning device for tensioning the belt wherein the tensioning device couples with an end of the belt, the tensioning device including a pair of springs substantially collinearly aligned to provide variable tensioning to the belt so that only the belt contacts the refuse container and the belt is devoid of contact with the arms as the arms move about the refuse container.

2. The grabber assembly of claim 1, wherein the pair of springs having a first and second spring rate.

3. The grabber assembly of claim 2, wherein the second spring rate is larger than the first spring rate.

4. A grabber assembly comprising:

a base for securing with a refuse collection device;

a pair of arms pivotally coupled with the base, the pair of arms moving between a grasping position and a release position;

a belt coupled with the arms, the belt contacting a refuse container in the grasping position for lifting the refuse container; and a pair of flippers actuated independently with respect to the arms, one flipper coupled with each distal end of the arms, the flippers being movable between a grasping and release position for initially contacting the refuse container and moving the refuse container to a position where it can be contacted by the belt.

5. The grabber assembly of claim 4, wherein the pair of flippers can be positioned substantially parallel to each other.

6. A grabber assembly comprising:

a base for securing with a refuse collection device;

a pair of arms pivotally coupled with the base, the pair of arms moving between a grasping position and a release position;

a belt coupled with the arms, the belt contacting a refuse container in a grasping position; and a pair of readily removable gear sections meshing with one another for moving the arms with respect to one another, at least one of the removable gear sections including a pair of spaced plates and a gear portion positioned between the spaced plates, the gear portion being directly connected with the spaced plates during operation and readily removable from the spaced plates.

7. The grabber assembly of claim 6, wherein the at least one gear section includes a housing having a bore for receiving a pivot pin and the pair of spaced plates coupled with the housing.

8. The grabber assembly of claim 7, wherein at least one removable fastener secures the gear portion with the plates.

* * * * *